US006034646A

United States Patent [19]

Heddebaut et al.

[11] Patent Number: 6,034,646

[45] Date of Patent: Mar. 7, 2000

[54] INFORMATION TRANSMISSION DEVICE AND METHOD FOR SYSTEMS USING RADIATING WAVEGUIDES

[75] Inventors: Marc Heddebaut; Jean Rioult; Marion Berbineau, all of Villeneuve D'Ascq; Denis Duhot, Paris, all of France

[73] Assignee: GEC Alsthom Transport SA, Paris, France

[21] Appl. No.: 08/797,273

[22] Filed: Feb. 7, 1997

[30] Foreign Application Priority Data

Feb. 9, 1996 [FR] France ..... 96 01 620

[51] Int. Cl.[7] ..... H01Q 13/10

[52] U.S. Cl. ..... 343/771; 343/767; 342/457

[58] Field of Search ..... 343/771, 770, 343/762, 767; 342/457, 454; H01Q 13/10

[56] References Cited

U.S. PATENT DOCUMENTS

| | | | |
|---|---|---|---|
| 3,546,633 | 1/1966 | Peppiatt . | |
| 3,629,707 | 12/1971 | Baba | 340/48 |
| 3,845,415 | 10/1974 | Ando . | |
| 4,823,138 | 4/1989 | Shibano et al. | 342/457 |
| 4,873,531 | 10/1989 | Heddebaut | 343/711 |
| 4,932,617 | 6/1990 | Heddebaut et al. | 246/8 |
| 5,430,455 | 7/1995 | Heddebaut et al. | 342/457 |
| 5,684,489 | 11/1997 | Fournier | 342/22 |
| 5,760,733 | 6/1998 | Fournier | 342/146 |

FOREIGN PATENT DOCUMENTS 05 29581 A1 3/1993 European Pat. Off. .

OTHER PUBLICATIONS

Duhot et al, "Iago: Transmission on Radiating Waveguides in the Transport Field", *GEC Alsthom Technical Review*, No. 6, Jul. 1991, Paris, France, pp. 59–66.

*Primary Examiner*—Don Wong
*Assistant Examiner*—Shih-Chao Chen
*Attorney, Agent, or Firm*—Sughrue, Mion, Zinn, Macpeak & Seas, PLLC

[57] ABSTRACT

In an information transmission device and method for systems using radiating waveguides along which a mobile travels, an unmodulated carrier wave is injected into the radiating waveguide. Some of the energy of the unmodulated carrier wave is sampled locally along the radiating waveguide. A local modulation signal representing information addressed to the mobile modulates the unmodulated carrier wave. The modulated carrier wave is radiated to the mobile.

39 Claims, 3 Drawing Sheets

INFORMATION TRANSMISSION DEVICE AND METHOD FOR SYSTEMS USING RADIATING WAVEGUIDES

BACKGROUND OF THE INVENTION

1. Field of the Invention

The present invention concerns information transmission devices and methods in general and, more particularly, an information transmission device and method for systems using radiating waveguides.

2. Description of the Prior Art

The IAGO system is an information and automation system using radiating waveguides and is described, for example, in "THE USE OF RADIATING WAVEGUIDES IN GUIDED TRANSPORTATION SYSTEMS", by Marc HEDDEBAUT and Marion BERBINEAU, special issue No. 8, published by the Institut National de Recherche sur les Transports et leur Sécurité.

This system is able to locate mobiles traveling along the radiating waveguide.

This location is based on the use of dedicated location slots.

These location slots are complementary and perpendicular to slots disposed regularly and continuously along the radiating waveguide.

The regular slots are used for high bit rate transmission of information and to measure the speed of the mobiles.

The information relating to the location of the mobiles is only available when the mobile is moving along the radiating waveguide, however.

In some applications, the mobile is in a workshop area or in a parking area or at the entry to a station. For these applications it is necessary to provide an information transmission device that can be read when the mobile is stopped or even parked above the information transmission device.

For applications in which the mobile moves along the radiating waveguide, it is necessary to provide a high bit rate information transmission device.

One aim of the invention is therefore an information transmission device for systems using radiating waveguides.

Another aim of the invention is an information transmission method for systems using radiating waveguides.

SUMMARY OF THE INVENTION

The invention consists in an information transmission device for systems using radiating waveguides along which a mobile travels, including:

means for injecting an unmodulated carrier wave into said radiating waveguide, means for localized sampling along said radiating waveguide of some of the energy of said unmodulated carrier wave, modulator means for modulating said unmodulated carrier wave using a local modulation signal representing information addressed to said mobile, and means for radiating a modulated carrier wave to said mobile.

The information transmission device of the invention for systems using radiating waveguides can also have any of the features of the accompanying subsidiary claims.

The invention also consists in an information transmission method for systems using radiating waveguides along which a mobile travels, including the following principal steps:

injecting an unmodulated carrier into said radiating waveguide, localized sampling along said radiating waveguide of some of the energy of said unmodulated carrier wave, modulating said unmodulated carrier wave using a local modulation signal representing information addressed to said mobile, and radiating the modulated carrier wave to said mobile.

The information transmission method of the invention for systems using radiating waveguides can also have any of the features of the accompanying subsidiary claims.

The information transmission device of the invention for systems using radiating waveguides may be entirely implemented using a short straight section of radiating waveguide, for example, its length being similar to the wavelength in air of the signals propagated in the radiating waveguide.

A technology of this kind was used to build a prototype originally constructed in the laboratories of the Institut National de Recherche sur les Transports et leur Sécurité.

One advantage of the information transmission device and method of the invention for systems using radiating waveguides is that it samples only a very small amount of energy, around 0.02 dB, from the radiating waveguide, so that transmission devices may be provided as often as the operation of the mobiles along the radiating waveguide makes necessary.

Another advantage of the information transmission device and method of the invention for systems using radiating waveguides is that they provide a simple and autonomous system with the minimum of components and connections.

Another advantage of the information transmission device and method of the invention for systems using radiating waveguides is that they do not require a continuous power supply.

Another advantage of the information transmission device and method of the invention for systems using radiating waveguides is that they can provide a precise location pulse signal.

Another advantage of the information transmission device and method of the invention for systems using radiating waveguides is that they can indicate the direction of movement of the mobile without ambiguity.

Other aims, features and advantages of the invention will emerge from a reading of the description of the preferred embodiment of the information transmission device and method for systems using radiating waveguides given with reference to the drawings.

DETAILED DESCRIPTION OF THE PREFERRED EMBODIMENT

The IAGO system uses the great bandwidth of a $TE_{01}$ mode microwave waveguide for high bit rate transmission of information between mobiles and the ground.

The great bandwidth also enables an unmodulated additional carrier wave to be transmitted in the radiating waveguide.

This unmodulated carrier wave is emitted at a low level and propagates all along the radiating waveguide.

The unmodulated carrier wave is not strongly attenuated and it is amplified by the same in-line repeaters as are used to regenerate the other signals transmitted in the radiating waveguide.

The unmodulated carrier wave is therefore present over all the length of the radiating waveguide, and essentially inside the waveguide.

The unmodulated carrier wave is not discernible from the mobile and initially does not carry any identifiable signature or information.

In accordance with the invention, the information transmission device and method for systems using radiating waveguides, for example the IAGO system, sample some of the energy propagating in the waveguide in a manner that is not discernible in the overall energy balance at locations along the radiating waveguide that are strategic in terms of operation of mobiles.

The energy sampled is radiated to the mobile.

At this time, a local modulation signal that is required to be delivered to the mobile traveling along the waveguide is applied to the unmodulated carrier wave.

Figure 1:
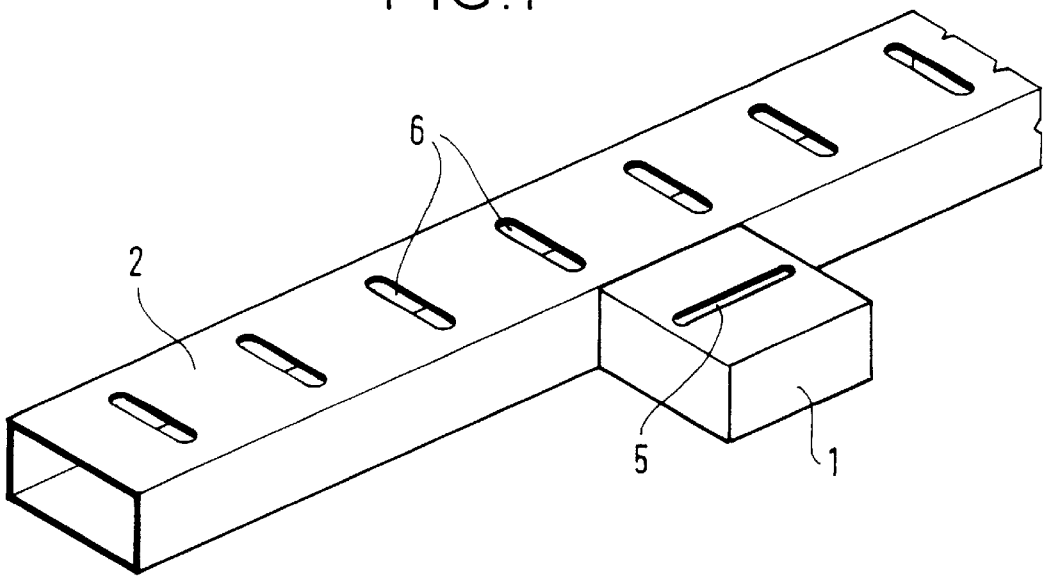
FIG. 1 is a general view of a preferred embodiment of the information transmission device of the invention for systems using radiating waveguides.

FIG. 1 is a general view of a preferred embodiment of the information transmission device of the invention for systems using radiating waveguides.

In the preferred embodiment of the information transmission device of the invention for systems using radiating waveguides, the mobile (not shown) is a rail vehicle.

It is clear that in other applications the mobiles can be waggons or any other mobile means.

As shown in FIG. 1, there is a resonant cavity 1 on one side of the radiating waveguide 2.

The radiating waveguide 2 and the resonant cavity 1 each comprise a respective directional coupler 3 and 4, on their sides facing towards each other.

The directional couplers are, for example, two circular apertures the dimensions of which are large in comparison to the period of the unmodulated carrier wave.

Figure 2:
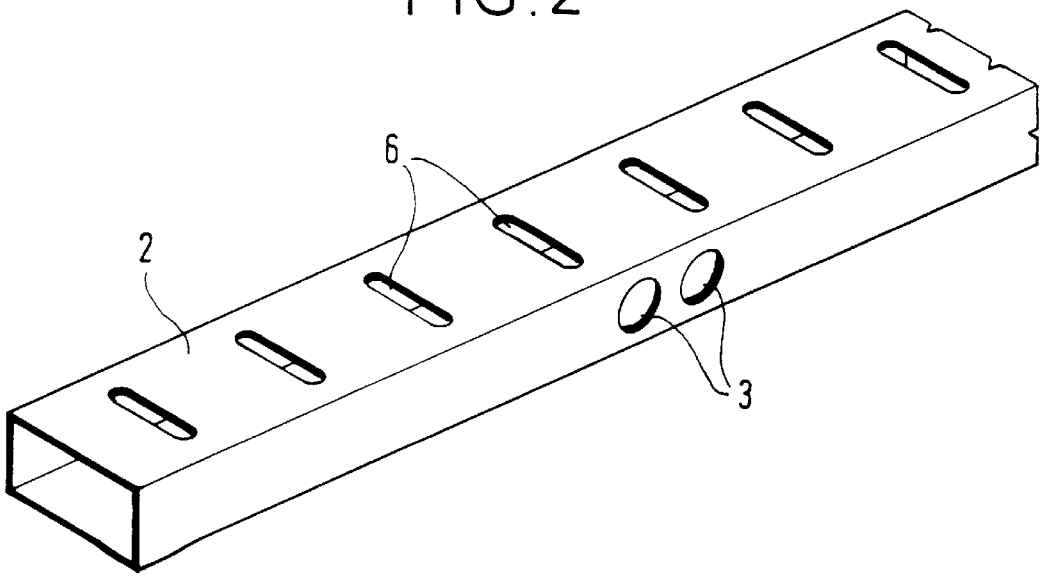
FIG. 2 shows the radiating waveguide and its directional coupler of the transmission device of FIG. 1.

FIG. 2 shows the radiating waveguide of the transmission device from FIG. 1 and its directional coupler.

Figure 3A:
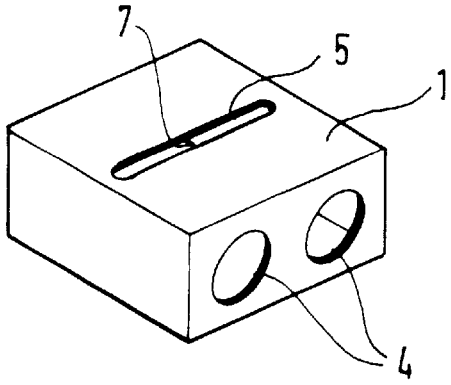
FIG. 3A shows the resonant cavity of the transmission device from FIG. 1.

FIG. 3A shows the resonant cavity of the transmission device from FIG. 1 and its directional coupler.

In the IAGO system, the radiating waveguide operates in $TE_{01}$ mode. There is therefore virtually no electric field to the lateral sides of the radiating waveguide.

The apertures must therefore be large to achieve the required level of coupling; accordingly, this dimension is not very critical from the mechanical point of view.

A construction of this kind provides repetitive coupling coefficients in the order of −40 dB relative to the power level transmitted in the radiating waveguide.

The length of the resonant cavity 1 is made as small as possible so that the interior volume of the resonant cavity resonates in a $TE_{011}$ fundamental mode. In this type of embodiment of the resonant cavity, all directional characteristics are eliminated and the coupling coefficient remains exactly the same whether the radiating waveguide is fed from the upstream or downstream end.

The $TE_{011}$ fundamental mode resonant cavity is short-circuited at its ends and incorporates a half-wave resonant slot 5.

The half-wave resonant slot is formed on the large exterior face of the resonant cavity facing towards the rail vehicle.

The half-wave resonant slot is perpendicular to the slots 6 of the radiating waveguide.

The half-wave resonant slot radiates the energy coupled from the radiating waveguide towards the $TE_{011}$ mode resonant cavity.

The half-wave resonant slot radiates with linear polarization perpendicular to the regular slots of the radiating waveguide.

These regular slots are the transmission and speed measurement slots of the waveguide.

This radiation provides approximately 15 dB of decoupling relative to the signals transmitted by the transmission and speed measurement slots of the waveguide.

The carrier wave propagating in the waveguide, which is a pure sinusoidal signal, is locally coupled to the rail vehicle by means of the resonant cavity and its half-wave resonant slot.

This sinusoidal signal is modulated locally.

To achieve this a modulator device 7 such as a Schottky type diode, for example, is disposed between the edges of the half-wave resonant slot at a point which has a high impedance at the required frequency.

Figure 3B:
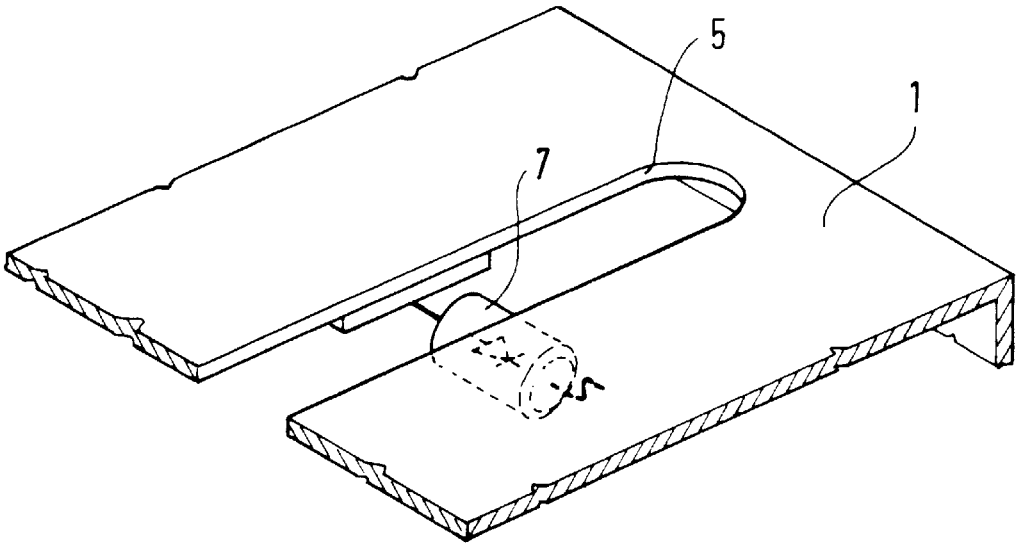
FIG. 3B shows the top face of the resonant cavity and its modulator device.

FIG. 3B shows the resonant cavity and its modulator device 7.

This diode is biased by a direct current applied to its terminals and when so biased short-circuits the half-wave resonant slot, the slot having a high impedance at this point at the working frequency in question.

This causes amplitude modulation of the pure sinusoidal signal sampled along the radiating waveguide.

The coupling coefficient between the radiating waveguide and the resonant cavity being in the order of −40 dB, the mismatch associated with this short-circuit at the timing rate of the modulation is not detectable in the radiating waveguide.

Likewise, considering a microwave power frequency level in the radiating waveguide, the modulated signal is re-injected into the radiating waveguide at best only at a level of −80 dB relative to the reference level, that is to say −40 dB in the radiating waveguide to resonant cavity direction and −40 dB in the resonant cavity to radiating waveguide direction.

The modulated signal produced in the resonant cavity is therefore not transmitted along the radiating waveguide and does not have any effect upstream or downstream of the resonant cavity.

The device 8 generates the signal representing the information to be transmitted to the rail vehicle.

This signal representing the information to be transmitted is a bit stream, for example.

The possible bit rate is high and is limited only by the switching time of the Schottky diode and the frequency of the pure sinusoidal signal.

To give an idea of the order of magnitude, several megabits per second may be available.

The device 8 generating the signal representing the information to be transmitted may comprise a picocontroller type device storing a frame in an EEPROM type memory and generating the frame repetitively for application to the Schottky diode as soon as it is supplied with energy.

Other suitable devices able to bias the Schottky diode at the rate of application of the information to be transmitted may be used.

As the energy present in the resonant cavity is very low, in the order of 40 dB below the power level present in the radiating waveguide, it is possible to dispose the device 8 generating the signal representing the information to be transmitted judiciously within the resonant cavity without significantly disturbing either the operation of this electronic circuit or the fundamental mode resonance of the resonant cavity.

Figure 3C:
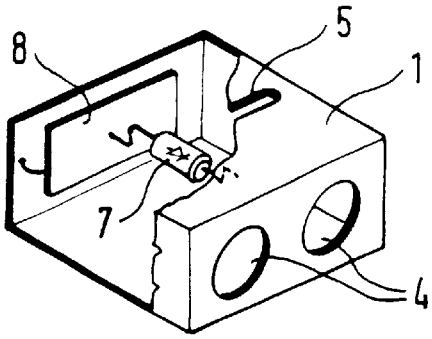
FIG. 3C shows the resonant cavity and its device generating the signal representing the information to be transmitted.

FIG. 3C shows the resonant cavity and its device for generating the signal representing the information to be transmitted.

The device 8 generating the signal representing the information to be transmitted may advantageously be supplied with power, for example with a current of a few milliamperes at a voltage of 5 V, by a remote power feeding arrangement using a low-frequency signal, i.e. a signal at a few hundred kilohertz or even a few megahertz.

Figure 4:
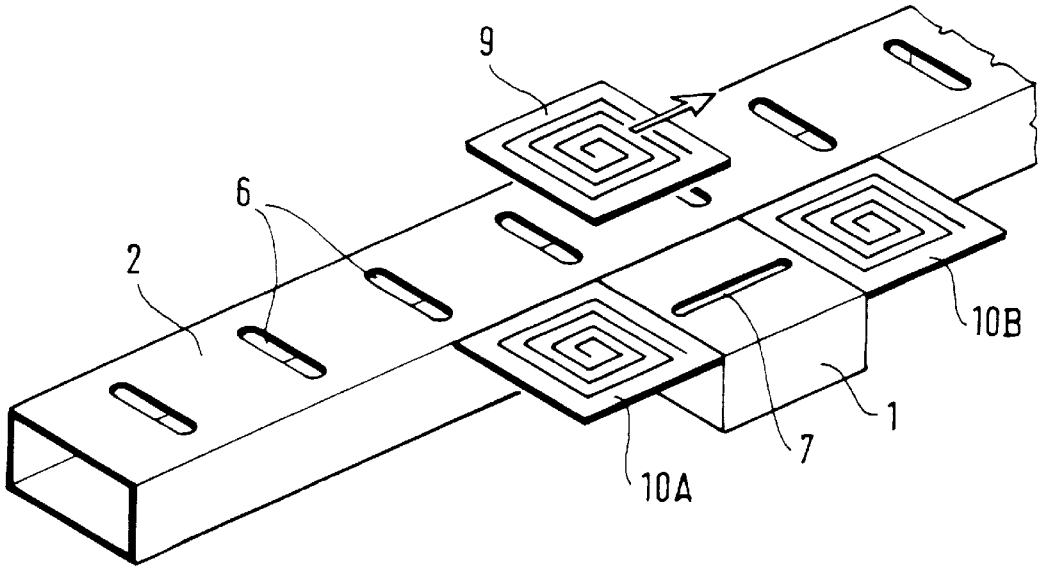
FIG. 4 is a general view of the information transmission device and its remote power feed device.

FIG. 4 is a general view of the information transmission device and its remote power feed device.

The low-frequency signal is coupled magnetically to the resonant cavity by means of two resonant loops 9, 10A or 10B.

For example, a serial type first resonant loop 9 is associated with the emission of energy and a parallel type second resonant loop 10A, 10B is associated with the reception of energy, the energy being emitted and received at the remote power feed frequency.

The energy emitting loop 9 is attached to the rail vehicle (not shown) and generates continuously a low level of energy, for example less than 1 watt, to be picked up by at least one energy receiver loop 10A, 10B attached to the resonant cavity 1.

The energy receiver loop 10A, 10B provides a remote power feed to the device 8 generating the signal representing the information to be transmitted when the rail vehicle passes.

Despite the fact that the microwave radiation from the energy emitting loop 9 is not closely controlled and may propagate relatively far from the resonant cavity by reflection or diffraction, the signal representing the information to be transmitted to the rail vehicle is generated only when the device 8 generating the signal representing the information to be transmitted is supplied with power via the remote power feed.

Protection against crosstalk is obtained by the fact that the microwave radiation from the energy emitting loop 9 is a low-frequency signal the amplitude of which decreases in accordance with the laws of magnetostatics, that is to say in inverse proportion to the cube of the distance between the emitter and the receiver.

In one embodiment a first energy receiver loop 10A is disposed on the upstream side of the resonant cavity 1 and provides a DC supply voltage $V_1$ as the rail vehicle approaches or moves away and a second energy receiver loop 10B is disposed on the downstream side of the resonant cavity 1 and provides a DC supply voltage $V_2$ as the rail vehicle moves away or approaches.

The device 8 generating the signal representing the information to be transmitted can therefore be continuously energized by the remote power feed as the rail vehicle passes from the upstream side to the downstream side of the resonant cavity or vice versa.

The transition from the DC voltage $V_1$ to the DC voltage $V_2$ or vice versa can be used to provide a signal indicating passage of the rail vehicle over the resonant cavity.

The transition from the DC voltage $V_1$ to the DC voltage $V_2$ can also be used to provide a signal indicating that the rail vehicle passed in the upstream to downstream direction.

The transition from the DC voltage $V_2$ to the DC voltage $V_1$ can also be used to provide a signal indicating that the rail vehicle passed in the downstream to upstream direction.

Figure 5:
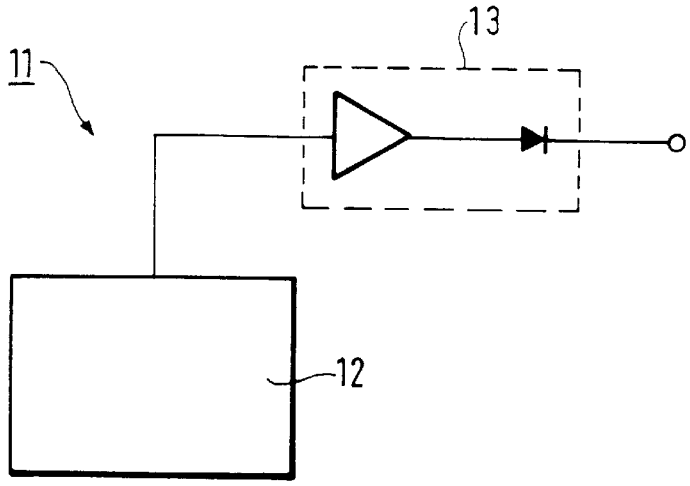
FIG. 5 shows one embodiment of the modulated carrier wave receiver device on the mobile.

FIG. 5 shows one embodiment of the modulated carrier wave receiver device disposed on the mobile.

This receiver device 11 comprises an antenna 12 connected to a system 13 providing amplification, filtering at the frequency of the pure sinusoidal signal and amplitude detection, and its function is to reconstitute the information transmitted.

There is claimed:

1. An information transmission device for systems using radiating waveguides along which a mobile travels, said device including:

means for injecting an unmodulated carrier wave into said radiating waveguide, means for localized sampling along said radiating waveguide of some of the energy of said unmodulated carrier wave, modulator means for modulating said unmodulated carrier wave using a local modulation signal representing information addressed to said mobile, and means for radiating a modulated carrier wave to said mobile.

2. The device as claimed in claim 1 including a resonant cavity on one side of said radiating waveguide.

3. The device claimed in claim 2 wherein said resonant cavity has a length such that its interior volume resonates in a $TE_{011}$ fundamental mode.

4. The device claimed in claim 3 wherein said $TE_{011}$ fundamental mode resonant cavity is short-circuited at its ends.

5. The device claimed in claim 1 wherein said sampling means comprise a respective directional coupler on facing sides of said radiating waveguide and said resonant cavity.

6. The device claimed in claim 5 wherein said directional couplers comprise at least one aperture.

7. The device claimed in claim 2 wherein said radiating means include a half-wave resonant slot in said resonant cavity.

8. The device claimed in claim 7 wherein said half-wave resonant slot is on a large exterior face of said resonant cavity facing towards said mobile.

9. The device claimed in claim 7 wherein said half-wave resonant slot is perpendicular to slots of said radiating waveguide.

10. The device claimed in claim 7 wherein said modulator means include a modulator device between the edges of said half-wave resonant slot at a point of high impedance at the required frequency.

11. The device claimed in claim 10 wherein said modulator device includes a Schottky diode biased by a direct current applied to the terminals of said diode which short-circuits said half-wave resonant slot when so biased.

12. The device as claimed in claim 10 including a device for generating a signal representing information to be transmitted and which biases said modulator device.

13. The device as claimed in claim 10 including a device for generating a signal representing information to be transmitted inside said resonant cavity.

14. The device as claimed in claim 10 including a device for generating a signal representing information to be transmitted and remote power feed means by which said device is supplied with power.

15. The device claimed in claim 14 wherein said remote power feed to said device for generating said signal representing said information to be transmitted is effected by means of a signal at a low frequency between a few hundred kilohertz and a few megahertz.

16. The device as claimed in claim 14 including a loop attached to said mobile adapted to emit energy to at least one energy receiver loop attached to said resonant cavity to effect said remote power feed.

17. The device as claimed in claim 16 including a first energy receiver loop on the upstream side of said resonant cavity to provide a direct current power supply voltage $V_1$ when said mobile is approaching or moving away and a second energy receiver loop on the downstream side of said resonant cavity to provide a direct current power supply voltage $V_2$ when said mobile is moving away or approaching.

18. The device as claimed in claim 1 including a device for receiving said modulated carrier wave on said mobile.

19. The device claimed in claim 18 wherein said receiver device includes an antenna connected to a system providing amplification, filtering at the frequency of said pure sinusoidal signal and amplitude detection.

20. An information transmission method for systems using radiating waveguides along which a mobile travels, including the following principal steps:

injecting an unmodulated carrier wave into said radiating waveguide, localized sampling along said radiating waveguide of some of the energy of said unmodulated carrier wave, modulating said unmodulated carrier wave using a local modulation signal representing information addressed to said mobile, and radiating a modulated carrier wave to said mobile.

21. The method claimed in claim 20 wherein the step of localized sampling of some of the energy of said unmodulated carrier wave is effected by means of directional means disposed on facing sides of said radiating waveguide and said resonant cavity.

22. The method as claimed in claim 20 comprising a step wherein a resonant cavity disposed on one side of said radiating waveguide resonates in a $TE_{011}$ fundamental mode.

23. The method claimed in claim 20 wherein said step of using a local modulation signal to modulate said unmodulated carrier wave is effected by applying to the terminals of a modulator device a direct current to bias said modulator device and to short-circuit a half-wave resonant slot when said bias is applied, said resonant slot forming part of said resonant cavity.

24. The method claimed in claim 23 wherein said modulator device is biased by means of a signal representing information to be transmitted.

25. The method as claimed in claim 23 comprising a step of memorizing a frame in an EEPROM type memory by means of a picocontroller type device and of generating said frame repetitively for application to said modulator device as soon as energy is supplied to it.

26. The method as claimed in claim 23 including a step of energizing a device for generating the signal representing information to be transmitted by remote power feed means.

27. The method claimed in claim 26 wherein said remote power feed to said device for generating said signal representing information to be transmitted is effected by means of a signal at a low frequency between a few hundred kilohertz and a few megahertz.

28. The method as claimed in claim 27 including a step of magnetically coupling said low-frequency signal to said resonant cavity by means of two resonant loops.

29. The method as claimed in claim 28 including a step of associating a serial type first resonant loop with the emission of energy and a parallel type second resonant loop with the reception of energy.

30. The method claimed in claim 29 wherein said emission and said reception of energy are effected at the remote power feed frequency.

31. The method claimed in claim 28 wherein said remote power feed to said device for generating said signal representing information to be transmitted is effected by means of said energy receiver loop when said mobile passes.

32. The method as claimed in claim 31 wherein a first energy receiver loop on the upstream side of said resonant cavity provides a direct current supply voltage $V_1$ when said mobile is approaching or moving away and a second energy receiver loop on the downstream side of said resonant cavity provides a direct current supply voltage $V_2$ when said mobile is moving away or approaching.

33. The method claimed in claim 32 wherein a transition from said direct current voltage $V_1$ to said direct current voltage $V_2$ or vice versa provides a signal indicating passage of said mobile over said resonant cavity.

34. The method claimed in claim 32 wherein a transition from said direct current voltage $V_1$ to said direct current voltage $V_2$ produces a signal indicating that said mobile passes in an upstream to downstream direction.

35. The method claimed in claim 32 wherein a transition from said direct current voltage $V_2$ to said direct current voltage $V_1$ produces a signal indicating that said mobile passes in a downstream to upstream direction.

36. The method as claimed in claim 20 including a step of reconstituting information transmitted by means of a receiver device comprising an antenna connected to a system providing amplification, filtering at the frequency of said pure sinusoidal signal and amplitude detection.

37. An information transmission system comprising:

a radiating waveguide for propagating an unmodulated including slots disposed continuously along said waveguide;

a resonant cavity disposed on a side of said waveguide including a half-wave resonant slot;

a directional coupler disposed between said waveguide and resonant cavity; and a modulation circuit disposed in said resonant cavity between the edges of said half-wave slot, at a point that has high impedance at a required frequency, wherein said modulation circuit modulates said carrier wave using a local signal representing information addressed to a mobile.

38. The devices of claim 37 wherein the modulate signal produced in said resonant cavity is not transmitted along the radiating waveguide and does not have any effect upstream or downstream of the resonant cavity.

39. The device of claim 38 wherein said waveguide operates in the $TE_{01}$ mode and said resonant cavity resonates in a $TE_{011}$ mode.

* * * * *